US005260131A

United States Patent [19]

Fukui et al.

[11] Patent Number: 5,260,131

[45] Date of Patent: Nov. 9, 1993

[54] WATER-REPELLENT HYGROSCOPIC FIBER

[75] Inventors: Yuichi Fukui; Shigeki Hagura; Hajime Itoh, all of Otake, Japan

[73] Assignee: Mitsubishi Rayon Co., Ltd., Tokyo, Japan

[21] Appl. No.: 822,205

[22] Filed: Jan. 17, 1992

[30] Foreign Application Priority Data

Jan. 21, 1991 [JP] Japan ..... 3-004859
Jan. 21, 1991 [JP] Japan ..... 3-004860
Jan. 21, 1991 [JP] Japan ..... 3-004861

[51] Int. Cl.[5] ..... D01F 8/08

[52] U.S. Cl. ..... 428/373; 428/374

[58] Field of Search ..... 428/373, 374

[56] References Cited

FOREIGN PATENT DOCUMENTS 54-011327 1/1979 Japan .
55-112315 8/1980 Japan .
56-073117 6/1981 Japan .
57-17216 10/1982 Japan .
62-007286 2/1987 Japan .
64-61529 3/1989 Japan .
2-92192 4/1990 Japan .
2-210064 8/1990 Japan .

OTHER PUBLICATIONS

Patent Abstracts of Japan, vol. 11, No. 262 (C-442), Aug. 25, 1987, JP-A-62 062 912, Mar. 19, 1987, Ogawa Noyuki, et al., "Acrylic Antistatic Fiber and Production Thereof".

Patent Abstracts of Japan, vol. 5, No. 195 (C-83), Dec. 11, 1981, & JP-A-56 118 910, Sep. 18, 1981, Bam Kaoru, et al., "Water Absorbing Acrylonitrile Fiber".

Database WPIL, AM 75-56154W, & JP-A-49 116 326, Nov. 7, 1974.

Database WPIL, AM-82-73520E, & JP-A-57 119 932, Jul. 26, 1992.

JIS L 1092, 5.2 Water Repellency Test (Spray Test), pp. 1-5.

JIS L 1013, 7.2 Equilibrium Moisture Regain, pp. 1-2.

*Primary Examiner*—Patrick J. Ryan
*Assistant Examiner*—Richard C. Weisberger
*Attorney, Agent, or Firm*—Oblon, Spivak, McClelland, Maier & Neustadt

[57] ABSTRACT

A water-repellent, hygroscopic conjugate fiber which has a water-repellency of at least 80 marks and an equilibrium moisture regain of at least 5% by weight at the standard conditions.

5 Claims, No Drawings

WATER-REPELLENT HYGROSCOPIC FIBER

BACKGROUND OF THE INVENTION

Field of the Invention

The present invention relates to a novel fiber which is excellent in water-repellency and hygroscopic property. The present invention also relates to a water-repellent hygroscopic fiber which additionally has an excellent antistatic property or a dyeability. The present invention further relates to a dyeable and antistatic, water-repellent hygroscopic fiber. The term "hygroscopic property" in this specification is particularly intended to mean the ability to absorb water vapor.

Discussion of the Background

One of the major objects of clothes is to protect the skin from the environmental conditions. The protection of the skin from water such as rain is a fundamental function of clothes. Hithertofore, production of water-repellent fibers has been developed by using various fluorine containing polymers, silicones or polyurethanes.

On the other hand, comfort with clothes is a subject which should always be kept in mind. The ability to absorb water vapor which comes out from the body through the skin by perspiration is a function primary required for garment fibers. The static electricity generated on clothes is very unpleasant and even dangerous in some cases. Thus, impartment of antistatic property to fibers is an important subject for the textile industry. Further, dyeability is another important factor required for fibers because the fibers are used in various colors and designs.

Water-repellency is generally considered to be completely in conflict with the hygroscopic property, antistatic property and dyeability. Specifically, the surface of a fiber must be covered with a hydrophobic material in order to provide the water-repellency for the fiber. Thus, conventional water-repellent fibers have not been hygroscopic and tend to generate a serious amount of static electricity. Water-repellent fibers are very difficult to wet with water which is generally employed as a medium in a dyeing process. This property provides fibers with a stain resistance which is a practical function of the water-repellent fibers. For this reason, the water-repellency is generally incompatible with the hygroscopic property, antistatic property and dyeability. It has so far been considered impossible to prepare a fiber which is excellent in the water-repellency and at the same time excellent in the hygroscopic property, antistatic property and dyeability. In fact, a fiber having these properties cannot be prepared by treating a fiber with a polymer such as silicone in a step of the after-treatment of fiber. Thus, attempts have been made to obtain textile products having excellent water-repellency, hygroscopic property, antistatic property and dyeability by weaving or knitting water-repellent fibers together with hygroscopic, antistatic and/or dyeable fibers.

These processes, however, have not fully achieved the expected purpose and it has been strongly desired to develop a fiber which integrates these conflicting functions into a single fiber. Development of this fiber will rapidly expand the field of application of water-repellent fibers.

SUMMARY OF THE INVENTION

The object of the present invention is to provide a fiber which simultaneously provides incompatible features, that is, the water-repellency together with the hygroscopic property, antistatic property and/or dyeability.

An aspect of the present invention is directed to a water-repellent hygroscopic fiber having a water repellency of at least 80 marks and an equilibrium moisture regain of at least 5% by weight at the standard conditions. Another aspect of the present invention is directed to an excellent water-repellent, hygroscopic and antistatic fiber which has a water repellency of at least 80 marks, an equilibrium moisture regain of at least 5% by weight at the standard conditions, and a half life of electro static charge of less than about 20 seconds. Still another aspect of the present invention is directed to a water-repellent, hygroscopic and antistatic fiber having a good dyeability.

DETAILED DESCRIPTION OF THE INVENTION

The fiber of the present invention is a conjugate fiber composed of a core component and a sheath component.

The water-repellent hygroscopic fiber of the present invention has a water-repellency of at least 80 marks as measured by the spray method in accordance with JIS L-1092, and an equilibrium moisture regain of at least 5% by weight measured at the standard conditions (20° C., 65% RH) in accordance with JIS L-1013.

When the water-repellency of the fiber is at least 80 marks, water or rain is repelled with ease in the form of water drops. When the water-repellency of the fiber is less than 80 marks, repelling of water is insufficient. When the equilibrium moisture regain of the fiber is at least 5% by weight, the fiber favorably absorbs water vapor which comes out from the body by perspiration and gives comfortable feeling to human beings. The fiber of the present invention integrates these features into a single fiber. This fiber is preferably composed of the following core component and sheath component:

The core component comprises a polymer (polymer Ia) comprising 50 to 95% by weight of acrylonitrile and 5 to 50% by weight of a vinyl comonomer (comonomer A) which is copolymerizable with acrylonitrile and has a solubility in water of at least 50 g/dl at 20° C. The sheath component comprises a polymer (polymer II) having a contact angle with water of at least 90° when cast into a film. The fiber having a water-repellency of at least 80 marks can be obtained by using the core component comprising the polymer Ia and the sheath component comprising the polymer II.

The amount of a vinyl monomer or comonomer such as acrylonitrile or acrylamide in this specification is intended to mean the amount of each monomer unit in a polymer.

The polymer (polymer II) having a contact angle with water of at least 90° is preferably a copolymer of 70 to 95% by weight of acrylonitrile and 5 to 30% by weight of a vinyl comonomer (comonomer B) which is copolymerizable with acrylonitrile and contains at least 30% by weight of fluorine.

The reason why an acrylonitrile polymer is selected as a principal polymer for forming the fiber of the present invention is that a fiber made of acrylonitrile polymer can be prepared by either wet spinning or dry spinning, and both spinning methods are suitable for forming a structure which is required for preparing a fiber having hygroscopic property as will be described below.

The function of the core component in the fiber of the present invention is to provide the hygroscopic property, antistatic property or dyeability for the fiber, and this object can be accomplished by preparing a copolymer of acrylonitrile and the vinyl comonomer (comonomer A) which is copolymerizable with acrylonitrile and has a high solubility in water, and spinning it as a core component in a sheath-core type conjugate spinning.

The preferred comonomer A has a solubility in water of at least 50 g/dl at 20° C. and includes, for example, acrylamide, diacetoneacrylamide, N-hydroxymethylacrylamide, (meth)acrylic acid, hydroxyethyl(meth)acrylic acid and diethylenedimethylsulfonic acid. Monomers having a solubility in water of less than 50 g/dl can not provide sufficient hygroscopic property for the fiber.

The polymer for the core component has preferably an acrylonitrile content of 70 to 95% by weight and a content of comonomer A of 5 to 30% by weight. Another comonomer can replace a portion of acrylonitrile or the comonomer A, if desired, so long as the contents of acrylonitrile and the comonomer are in the range mentioned above. An acrylonitrile content less than 70% by weight usually leads to a poor spinnability of the polymer and lowers the properties of the resulting fiber. On the other hand, an acrylonitrile content exceeding 95% by weight results in an insufficient hygroscopic property of the resulting fiber.

Further, the amount of comonomer A less than 5% by weight can not provide a sufficient hygroscopic property for the fiber. On the other hand, when the amount of comonomer A exceeds 30% by weight, the coagulation speed of a polymer solution becomes too slow, and in an extreme case, the polymer becomes soluble in water and can not coagulate.

The core component which can be used in another embodiment of the present invention includes natural polymers such as celluloses, cellulose derivatives, chitins and chitin derivatives. Celluloses, chitins and derivatives thereof are dissolved in a known solvent such as dimethylacetamide-lithium chloride, dimethylsulfoxide-paraformamide, N-methylmorpholine-N-oxide, dinitrogen tetraoxide-dimethylformamide and ammonium rhodanide-liquid ammonia, and the resulting solution is spun by wet or dry spinning process to form conjugate fibers. When the core component contains at least 50% by weight of a cellulose, chitin or a derivative thereof, a sufficiently hygroscopic fiber can be obtained. This fiber has a property of absorbing or releasing moisture depending upon the environmental conditions and is also excellent in the antistatic property and dyeability.

The core component may contain less than 50% by weight of other polymers, if desired, in addition to such a natural polymer as the cellulose mentioned above. Since the natural polymers mentioned above have good compatibility with acrylonitrile polymers, they can be mixed with the acrylonitrile copolymer (polymer Ia).

When the amount of the cellulose, chitin or derivative thereof is less than 50% by weight of the core component, properties of the cellulose or chitin cannot be exhibited.

The sheath component provides water-repellency for the fiber of the present invention. When a vinyl comonomer containing less than 30% by weight of fluorine is used, the water-repellency of the resultant fiber is usually insufficient.

The sheath component polymer (polymer II) preferably contains 70 to 95% by weight of acrylonitrile and 5 to 30% by weight of a vinyl comonomer (comonomer B) containing at least 30% by weight of fluorine. If desired, another comonomer can also be used in combination with the comonomer B so long as the above conditions are satisfied.

The comonomer B which can preferably be used includes, for example, trifluoromethyl(meth)acrylic acid, octafluorobutyl(meth)acrylic acid and heptadecafluorodecyl(meth)acrylic acid.

The amount of acrylonitrile less than 70% by weight in the polymer II leads to poor spinnability of the polymer and also lowers properties of the resulting fiber.

The amount of the comonomer B less than 5% by weight in the sheath component can not provide a satisfactory repellency for the resulting fiber. On the contrary, the amount of the comonomer B exceeding 30% by weight reduces the solubility of a polymer in a solvent for acrylonitrile polymer, for example, dimethylformamide, dimethylacetamide, dimethyl sulfoxide, γ-butyrolactone, ethylenecarbonate, aqueous nitric acid solution, aqueous sodium thiocyanate solution and aqueous zinc chloride solution. As a result, spinning of the polymer becomes difficult or impossible.

The fiber of the present invention comprises two kinds of polymers, that is, a core component and a sheath component, and forms a conjugate fiber having a sheath-core double layers in the cross section perpendicular to the direction of fiber length.

The sheath layer preferably has a thickness of 0.1 to 20 μm. A fiber having both of the water-repellency and the hygroscopic property can be obtained only by forming a conjugate structure in the fiber. The water-repellency is provided for the fiber by the thin-layered sheath component which constitutes the outer layer of the fiber. Water vapor or moisture comes into contact with the interior portion (core component) of the fiber through the thin layer to provide the hygroscopic property, antistatic property and dyeability for the fiber due to the hydrophilic property of the core component polymer.

The core/sheath component ratio in the fiber of the present invention is preferably in the range of 1/30 to 30/1 by weight, more preferably in the range of 1/30 to 10/1 by weight. When the core ratio is higher than the above range, a sufficient water-repellency can not be provided for the fiber.

Further, an embodiment of the present invention provides a water-repellent hygroscopic fiber having additional antistatic property. This fiber has a half-life of electro static charge of less than about 20 seconds. When the half-life is longer than 20 seconds, static electricity is liable to generate.

An acrylonitrile polymer (polymer Ib) having a half-life of electro static charge of less than 10 seconds is used for the core component of the fiber. The acrylonitrile polymer (polymer II) having a contact angle with water of at least 90° is used for the sheath component.

The function of the polymer Ib which constitutes the core component is to provide the hygroscopic property and antistatic property for the fiber. The polymer Ib is thus required to have a half-life of electro static charge of less than 10 seconds which is measured on a cast film of the polymer Ib. When a polymer having the half-life of longer than 10 seconds is used for the preparation of a conjugate fiber, a fiber having a half-life of electro static charge of less than about 20 seconds is difficult to obtain. A polymer, particularly, an acrylonitrile polymer blended with an antistatic agent can be used as the polymer Ib.

However, the polymer Ib is preferably a copolymer of 70 to 95% by weight of acrylonitrile and 5 to 30% by weight of alkoxypolyethylene glycol (meth)acrylic acid, vinyl diethyldimethylsulfonate or tetramethylammonium 2-acrylamide-2-methylpropanesulfonate. When the amount of acrylonitrile in the polymer Ib is less than 70% by weight, the spinnability of the polymer becomes poor and properties of the resulting fiber is deteriorated. On the contrary, the amount of acrylonitrile exceeding 95% by weight can not provide a satisfactory antistatic property for the fiber.

Further, when the amount of such a comonomer as alkoxypolyethylene glycol (meth)acrylic acid mentioned above is less than 5% by weight in the polymer Ib, a sufficient antistatic property can not be obtained. On the contrary, when the amount exceeds 30% by weight, the coagulation speed of a polymer solution becomes too slow as explained in the case of polymer A.

The sheath component polymer provides water-repellency for the fiber as described before.

The water-repellent hygroscopic fiber which additionally has the antistatic property comprises two kinds of polymers, polymer Ib and polymer II. This fiber is also a conjugate fiber of sheath-core double layers type in which the polymer Ib constitutes an interior portion and the polymer II constitutes an exterior layer in the cross section perpendicular to the direction of fiber length.

Further, it is also necessary that the core/sheath component ratio is in the range of 1/30 to 30/1 by weight, preferably in the range of 1/30 to 10/1 by weight as described before.

Another embodiment of the present invention provides a dyeable, water-repellent hygroscopic fiber or a dyeable, antistatic, water-repellent hygroscopic fiber. This fiber is also a conjugate fiber composed of a core component and a sheath component.

The core component may comprise a copolymer (polymer Ic) comprising 70 to 95% by weight of acrylonitrile and 5 to 30% by weight of a vinyl comonomer (comonomer C) which is copolymerizable with acrylonitrile and has a functional group selected from the group consisting of sulfonic acid, sulfuric acid, phosphonic acid, phosphoric acid, carboxyl, amino and quaternary ammonium base in a molecule. The sheath component comprises a copolymer (polymer II) comprising 70 to 95% by weight of acrylonitrile and 5 to 30% by weight of a vinyl comonomer (comonomer B) which is copolymerizable with acrylonitrile and contains at least 30% by weight of fluorine.

In the conjugate fiber of the present invention, the sheath layer has a fibril structure and micro-voids, and at least a portion of the outer surface of the sheath layer is connected with the core portion through micropores. This unique structure can provide the dyeability for the fiber in addition to the water-repellency and hygroscopic property and/or antistatic property.

The core portion of the fiber serves for providing the fiber with the dyeability. This object can be achieved by using a copolymer of acrylonitrile and a specific comonomer (comonomer C) which is copolymerizable with acrylonitrile. The comonomer C should have a functional group which can react with a dye molecule and fix it to the fiber. Exemplary comonomer C includes vinylpyridine, acrylamide, (meth)acrylic acid, vinylsulfonic acid, p-vinylbenzenesulfonic acid, p-vinylbenzoic acid, (meth)allylsulfonic acid, styrenesulfonic acid and metal salts of these compounds.

The polymer Ic preferably comprises 70 to 95% by weight of acrylonitrile and 5 to 30% by weight of the comonomer C. Other comonomers can be used, if desired, in combination with the comonomer C so long as the amount of acrylonitrile and the comonomer C remain in the above range.

When the amount of acrylonitrile is less than 70% by weight, the spinnability of the polymer is impaired and a sufficient dyeability can not be provided for the resulting fiber. When the amount of comonomer C is less than 5% by weight of the polymer Ic, a sufficient dyeability can not be provided for the fiber. On the contrary, too much amount of the comonomer C lowers the coagulation speed of a polymer solution in the spinning step and cannot provide excellent properties for the fiber.

The sheath layer of the fiber serves for providing the water-repellency. This object can be achieved by using the copolymer (polymer II) of acrylonitrile and a vinyl comonomer (comonomer B) which is copolymerizable with acrylonitrile and contains at least 30% by weight of fluorine for the sheath component. When the content of fluorine in the vinyl comonomer is less than 30% by weight, a sufficient water-repellency can not be obtained.

The water-repellent hygroscopic fiber having a good dyeability or antistatic property is a conjugate fiber composed of sheath-core double layers. Further, it is necessary that the exterior layer has micro-voids or gaps caused by fibril structure and that the interior portion of the fiber directly comes into contact with the outer environment of the fiber (atmosphere) by way of air tunnels (micro-pores).

The core/sheath component ratio in this embodiment is also preferably 1/30 to 30/1 by weight, more preferably in the range of 1/30 to 10/1 by weight.

The fiber having this structure exhibits the water-repellency by the water-repellent polymer constituting the exterior layer of the fiber. On the other hand, the dyeability is exhibited first by bringing a dye molecule into direct contact with the internal portion of the fiber through the micro-pores formed on the external layer of the fiber and then by reacting the dye with the functional group of the polymer which constitutes the internal portion of the fiber.

Such structures can be provided for the fiber by various processes.

For example, a sheath-core type conjugate fiber is prepared by a wet spinning process carried out under the conditions which are likely to generate micro-voids or likely to increase coagulation speed. Specifically, the temperature of a coagulation bath is raised, the concentration of a non-solvent is increased in a coagulation both, or the polymer concentration in a spinning solution is decreased, in consideration of polymer properties and its polymerization degree.

As an alternative, minute foreign matters are added into a polymer or its solution which is used to form an exterior layer in the wet or other spinning process for preparing a sheath-core type conjugate fiber. After the formation of the fiber by spinning, the foreign matters are removed from the fiber by a suitable method.

The fiber of the present invention is prepared in principle from acrylonitrile polymer. Thus, the former process can be effectively and readily employed for the preparation of the fiber of the present invention. Further, voids are liable to form on the fiber surface in the course of the fiber preparation because of the water-repellency of the polymer which constitutes the external layer. This phenomenon makes the employment of the former process favorable.

In an exemplary process, each of the polymers, for the core component and for the sheath component, are separately dissolved in dimethylformamide and wet spun to prepare sheath-core type conjugate fibers. The fiber of the present invention can be prepared without difficulties by using a solvent mixture of water and dimethylformamide for the coagulation bath.

The fiber of the present invention can be applied to the production of common clothes, sports clothes and also building materials such as interiors and partitions.

EXAMPLES

Now, the present invention will be described in further detail with reference to Examples. However, it should be understood that the present invention is by no means restricted by such specific Examples.

Properties of the fiber of the present invention were measured by the following methods:

Water repellency (mark) . . . Measured by the spray method in accordance with JIS L-1092

Equilibrium moisture regain (%) . . . Measured in accordance with JIS L-1013, under standard conditions.

Half-life of electro static charge (sec) . . . A specimen was mounted on a static honest meter, voltage was applied at 10000 V for 30 seconds under the rotation of the specimen of 1000 rpm, and thereafter the time when the electro static charge decreased to a half was measured. Measurement was carried out at 20° C., 65% RH. Shorter half-life indicates better antistatic property.

Rate of dyeing (%) . . . A fiber specimen was dyed with a dyeing formulation described below and dye absorption percentage was obtained by colorimetric analysis using a standard and a residual bathes.

| | |
|---|---|
| Aizen Cathilon Red GTLT (made by Hodogaya Chemical Co.) | 6.5% o.w.f. |
| Acetic acid | 2.0% o.w.f. |
| Sodium acetate | 1.0% o.w.f. |
| Liquor Ratio | 1/125 |
| Temperature × time | 125° C. × 30 min. |

EXAMPLE 1

A dimethylformamide solution containing 20% by weight of a copolymer (sheath component) composed of 95% by weight of acrylonitrile and 5% by weight of heptadecafluorodecylmethacrylic acid, and a dimethylformamide solution containing 22% by weight of a copolymer (core component) composed of 70% by weight of acrylonitrile and 30% by weight of acrylamide were extruded through a sheath-core conjugate spinning nozzle at a core/sheath component ratio of 1/5 by weight into a coagulation bath of an aqueous solution containing 70% by weight of dimethylformamide at a temperature of 30° C. to form fibers. The fibers thus formed were washed with boiling water while being stretched 3 times, dried by a drying roller at 120° C., and heat treated under a constant length with a heating roller at 200° C. to obtain fibers having the following properties:

| | |
|---|---|
| Fiber diameter | 25 μm |
| Sheath thickness | 5 to 10 μm |
| Water-repellency | 100 marks |
| Equilibrium moisture regain | 11% |

EXAMPLE 2

A dimethylformamide solution containing 20% by weight of a copolymer (sheath component) composed of 95% by weight of acrylonitrile and 5% by weight of heptadecafluorodecylmethacrylic acid and a dimethylformamide solution containing 20% by weight of a copolymer (core component) composed of 70% by weight of acrylonitrile and 30% by weight of sodium acrylate were extruded through a sheath-core conjugate spinning nozzle at a core/sheath component ratio of 1/5 by weight into a coagulation bath of an aqueous solution containing 70% by weight of dimethylformamide at a temperature of 30° C. to form fibers. The fibers thus formed were washed with boiling water while being stretched 3 times, dried by a drying roller at 120° C., and heat treated under a constant length with a heating roller at 200° C. to obtain fibers having the following properties:

| | |
|---|---|
| Fiber diameter | 25 μm |
| Sheath thickness | 5 to 10 μm |
| Water-repellency | 100 marks |
| Equilibrium moisture regain | 12% |

COMPARATIVE EXAMPLE 1

A dimethylformamide solution containing 20% by weight of a copolymer (sheath component) composed of 95% by weight of acrylonitrile and 5% by weight of heptadecafluorodecylmethacrylic acid and a dimethylformamide solution containing 20% by weight of a copolymer (core component) composed of 70% by weight of acrylonitrile and 30% by weight of acrylamide were extruded through a sheath-core conjugate spinning nozzle at a core/sheath component ratio of 62/1 by weight into a coagulation bath of an aqueous solution containing 70% by weight of dimethylformamide at a temperature of 30° C. to form fibers. The fibers thus formed were washed with boiling water while being stretched 3 times, dried by a drying roller at 120° C., and heat treated under a constant length with a heating roller at 200° C. to obtain fibers having the following properties:

| | |
|---|---|
| Fiber diameter | 15 μm |
| Sheath thickness | 0.05 to 0.07 μm |
| Water-repellency | 40 marks |
| Equilibrium moisture regain | 15% |

EXAMPLE 3

A dimethylacetamide solution containing 18% by weight of a copolymer (sheath component) composed of 95% by weight of acrylonitrile and 5% by weight of heptadecafluorodecylmethacrylic acid and a solution containing 6% by weight of cellulose pulp having an average polymerization degree of 500 (core component), 6% by weight of lithium chloride and 88% by weight of dimethylacetamide were extruded through a sheath-core conjugate spinning nozzle at a core/sheath component ratio of 1/5 by weight into a coagulation bath of an aqueous solution containing 60% by weight of dimethylacetamide at a temperature of 30° C. to form fibers. The fibers thus formed were washed with boiling water while being stretched 3 times, dried by a drying roller at 120° C., and heat treated under a constant length with a heating roller at 200° C. to obtain fibers having the following properties:

| | |
|---|---|
| Fiber diameter | 25 μm |
| Sheath thickness | 5 to 10 μm |
| Water-repellency | 100 marks |
| Equilibrium moisture regain | 12% |

EXAMPLE 4

A dimethylacetamide solution containing 20% by weight of a copolymer (sheath component) composed of 90% by weight of acrylonitrile and 10% by weight of trifluoromethylmethacrylic acid and a solution containing, as core components, 6% by weight of cellulose pulp having an average polymerization degree of 400 and 3% by weight of a copolymer composed of 70% by weight of acrylonitrile and 30% by weight of sodium methallylsulfonate, 6% by weight of lithium chloride, and 85% by weight of dimethylacetamide were extruded through a sheath-core conjugate spinning nozzle at a core/sheath component ratio of 1/4.3 by weight into a coagulation bath of an aqueous solution containing 60% by wight of dimethylacetamide at a temperature of 30° C. to form fibers. The fibers thus formed were washed with boiling water while being stretched 3 times, dried by a drying roller at 120° C., and heat treated under a constant length with a heating roller at 200° C. to obtain fibers having the following properties:

| | |
|---|---|
| Fiber diameter | 23 μm |
| Sheath thickness | 50 to 8 μm |
| Water-repellency | 90 marks |
| Equilibrium moisture regain | 11% |

EXAMPLE 5

A dimethylacetamide solution containing 18% by weight of a copolymer (sheath component) composed of 95% by weight of acrylonitrile and 5% by weight of heptadecafluorodecylmethacrylic acid and a solution containing 5% by weight of chitin having an average polymerization degree of 400 (core component), 5% by weight of lithium chloride and 90% by weight of dimethylacetamide were extruded through a sheath-core conjugate spinning nozzle at a core/sheath component ratio of 1/5 by weight into a coagulation bath of an aqueous solution containing 60% by weight of dimethylacetamide at a temperature of 30° C. to form fibers. The fibers thus formed were washed with boiling water while being stretched 3 times, dried by a drying roller at 120° C., and heat treated under a constant length with a heating roller at 200° C. to obtain fiber having the following properties:

| | |
|---|---|
| Fiber diameter | 25 μm |
| Sheath thickness | 5 to 10 μm |
| Water-repellency | 100 marks |

-continued

| | |
|---|---|
| Equilibrium moisture regain | 10% |

EXAMPLE 6

A dimethylformamide solution containing 20% by weight of a copolymer (sheath component) composed of 95% by weight of acrylonitrile and 5% by weight of heptadecafluorodecylmethacrylic acid and a dimethylformamide solution containing 20% by weight of a copolymer (core component) composed of 90% by weight of acrylonitrile and 10% by weight of alkoxypolyethylene glycol acrylic acid were extruded through a sheath-core conjugate spinning nozzle at a core/sheath component ratio of 3/1 by weight into a coagulation bath of an aqueous solution containing 70% by weight mixture of dimethylformamide at a temperature of 30° C. to form fibers. The fibers thus formed were washed with boiling water while being stretched 3 times, dried by a drying roller at 120° C., and heat treated under a constant length with a heating roller at 200° C. to obtain fibers having the following properties:

| | |
|---|---|
| Fineness | 10 d |
| Sheath thickness | 2 to 3 μm |
| Water-repellency | 90 marks |
| Electrification half-life | 8.5 sec |
| Equilibrium moisture regain | 6% |

COMPARATIVE EXAMPLE 2

A dimethylformamide solution containing 20% by weight of a copolymer (sheath component) composed of 95% by weight of acrylonitrile and 5% by weight of heptadecafluorodecylmethacrylic acid and a dimethylformamide solution containing 20% by weight of a copolymer (core component) composed of 90% by weight of acrylonitrile and 10% by weight of alkoxypolyethylene glycol acrylic acid were extruded through a sheath-core conjugate spinning nozzle at a core/sheath component ratio of 1/55 by weight into a coagulation bath of an aqueous solution containing 70% by weight of dimethylformamide at a temperature of 30° C. to form fibers. The fibers thus formed were washed with boiling water while being stretched 3 times, dried by a drying roller at 120° C., and heat treated under a constant length with a heating roller at 200° C. to obtain fibers having the following properties:

| | |
|---|---|
| Fineness | 10 d |
| Sheath thickness | 21 to 22 μm |
| Water-repellency | 100 marks |
| Electrification half-life | 21.0 sec |
| Equilibrium moisture regain | 3% |

COMPARATIVE EXAMPLE 3

A dimethylformamide solution containing 20% by weight of a copolymer (sheath component) composed of 95% by weight of acrylonitrile and 5% by weight of heptadecafluorodecylmethacrylic acid and a dimethylformamide solution containing 20% by weight of a copolymer (core component) composed of 90% by weight of acrylonitrile and 10% by weight of alkoxypolyethylene glycol acrylic acid were extruded through a sheath-core conjugate spinning nozzle at a core/sheath component ratio of 40/1 by weight into a coagulation bath of an aqueous solution containing 70% by weight of dimethylformamide at a temperature of 30° C. to form fibers. The fibers thus formed were washed with boiling water while being stretched 3 times, dried by a drying roller at 120° C., and heat treated under a constant length with a heating roller at 200° C. to obtain fibers having the following properties:

| | |
|---|---|
| Fineness | 10 d |
| Sheath thickness | 0.07 to 0.09 μm |
| Water-repellency | 50 marks |
| Electrification half-life | 8.0 sec |
| Equilibrium moisture regain | 7% |

EXAMPLE 7

A dimethylformamide solution containing 20% by weight of a copolymer (sheath component) composed of 95% by weight of acrylonitrile and 5% by weight of heptadecafluorodecylmethacrylic acid and a dimethylformamide solution containing 22% by weight of a copolymer (core component) composed of 70% by weight of acrylonitrile and 30% by weight of sodium methallylsulfonate were extruded through a sheath-core conjugate spinning nozzle at a core/sheath component ratio of 1/1.2 by weight into a coagulation bath of an aqueous solution containing 50% by weight of dimethylformamide at a temperature of 25° C. to form fibers. The fibers thus formed were washed with boiling water while being stretched 2.5 times, dried by a drying roller at 120° C., and heat treaded under a constant length with a heating roller at 200° C. to obtain fibers having the following properties:

| | |
|---|---|
| Fiber diameter | 22 μm |
| Sheath thickness | 3 to 4 μm |
| Core diameter | 15 μm |
| Sheath | penetrated with pores having an average diameter of 0.3 μm |
| Water-repellency | 100 marks |
| Rate of dyeing | 60% |
| Half-life of electro static charge | 12 sec |
| Equilibrium moisture regain | 7% |

COMPARATIVE EXAMPLE 4

A dimethylformamide solution containing 20% by weight of a copolymer (sheath component) composed of 95% by weight of acrylonitrile and 5% by weight of heptadecafluorodecylmethacrylic acid and a dimethylformamide solution containing 22% by weight of a copolymer (core component) composed of 70% by weight of acrylonitrile and 30% by weight of sodium methallylsulfonate were extruded through a sheath-core conjugate spinning nozzle at a core/sheath component ratio of 1/1.2 by weight into a coagulation bath of an aqueous solution of 70% by weight of dimethylformamide at a temperature of 25° C. to form fibers. The fibers thus formed were washed with boiling water while being stretched 2.5 times, dried by a drying roller at 120° C., and heat treated under a constant length with a heating roller at 200° C. to obtain fibers having the following properties:

| | |
|---|---|
| Fiber diameter | 22 μm |
| Sheath thickness | 3 to 4 μm |
| Core diameter | 15 μm |
| Sheath | No penetration of pores |
| Water-repellency | 100 marks |
| Rate of dyeing | 30% |
| Equilibrium moisture regain | 7% |

Ordinary fibers have an approximate equilibrium moisture regain as described below, respectively:

| | |
|---|---|
| Rayon | 11% |
| Polynosic | 11% |
| Acetate | 6.5% |
| Triacetate | 3.5% |
| Nylon | 4.5% |
| Vinylon | 5% |
| Polyester | 0.4% |
| Polypropylene | 0% |
| Acryl | 2% |

What is claimed is:

1. A water-repellent hygroscopic fiber having a water repellency of at least 80 marks and an equilibrium moisture regain of at least 5% by weight measured at 20° C. and 65% relative humidity and comprising a core component comprising
   (a) a polymer Ia comprising 50 to 95% by weight of acrylonitrile and 5 to 50% by weight of a vinyl comonomer A which is copolymerizable with acrylonitrile and has a solubility in water of at least 50 g/dl at 20 ° C.,
   (b) at least 50% by weight of a cellulose or a cellulose derivative, or
   (c) at least 50% by weight of a chitin or a chitin derivative, and a sheath component comprising a polymer II comprising 70 to 95% by weight of acrylonitrile and 5 to 30% by weight of a vinyl comonomer B which is copolymerizable with acrylonitrile and contains at least 30% by weight of fluorine, wherein said fiber has a core/sheath component ratio of 1/30 to 30/1 by weight.

2. The fiber according to claim 1 wherein said polymer II has a contact angle of at least 90° with water when cast into a film, and said sheath component has a thickness of 0.1 to 20 μm.

3. The fiber according to claim 1 wherein said fiber has a half-life of electro static charge of less than about 20 seconds.

4. The fiber according to claim 1, wherein said vinyl comonomer A is a compound selected from the group consisting of acrylamide, diacetoneacrylamide, N-hydroxymethylacrylamide, (meth)acrylic acid, hydroxyethyl(meth)acrylic acid, alkoxypolyethyleneglycol(-meth)acrylic acid and diethylenedimethylsulfonic acid.

5. The fiber according to claim 1, wherein said vinyl comonomer B is a compound selected from the group consisting of trifluoro(meth)acrylic acid, octafluorobutyl(meth)acrylic acid and heptadecafluorodecyl(meth)acrylic acid.

* * * * *